US005911537A

United States Patent [19]

Pulver

[11] Patent Number: 5,911,537

[45] Date of Patent: Jun. 15, 1999

[54] PARABOLIC COVER FOR MANHOLE

[76] Inventor: Mark D. Pulver, 102 Boyd Ave., Chittenango, N.Y. 13037

[21] Appl. No.: 08/796,867

[22] Filed: Feb. 6, 1997

[51] Int. Cl.[6] ..... E02D 29/14

[52] U.S. Cl. ..... 404/25; 52/20

[58] Field of Search ..... 404/25, 26; 52/19, 52/20; 137/371

[56] References Cited

U.S. PATENT DOCUMENTS

| | | | |
|---|---|---|---|
| 1,364,323 | 1/1921 | Shanley | 94/34 |
| 1,602,713 | 10/1926 | Shanley | 94/35 |
| 1,639,495 | 8/1927 | Frame | 94/34 |
| 1,940,924 | 12/1933 | Taylor | 154/45.5 |
| 2,358,750 | 9/1944 | Walker | 52/21 |
| 3,920,347 | 11/1975 | Sauriol | 404/25 |
| 4,408,421 | 10/1983 | Pai | 52/20 |
| 4,597,692 | 7/1986 | Gruenwald | 404/25 |
| 4,969,771 | 11/1990 | Bowman | 404/26 |
| 5,130,016 | 7/1992 | Gavin | 210/164 |
| 5,362,175 | 11/1994 | Begin | 404/26 |
| 5,378,078 | 1/1995 | Lewis | 404/25 |
| 5,401,114 | 3/1995 | Guggermos | 404/25 |
| 5,482,400 | 1/1996 | Bavington | 404/25 |
| 5,496,128 | 3/1996 | Odill | 404/25 |
| 5,525,006 | 6/1996 | Kilman et al. | 404/25 |

FOREIGN PATENT DOCUMENTS

| | | | |
|---|---|---|---|
| 2280921 | 2/1995 | United Kingdom | 404/25 |

OTHER PUBLICATIONS

Timoshenko, Strength of Material Part II, Advanced Theory and Problems, D. Van Nostrand Co., Inc. 2nd Ed. (1941), 10th Printing (1948), pp. 119–159.

*Primary Examiner*—James A. Lisehora
*Attorney, Agent, or Firm*—Trapani & Molldrem

[57] ABSTRACT

A manhole cover of substantially monolithic construction is claimed. The manhole cover comprises a central cover portion having a center, and having a thickness that varies radially from the center in accordance with an exponential or parabolic function. An intermediate cover portion surrounds the central cover portion and has a substantially uniform thickness. An outer bearing portion surrounds the intermediate cover portion and has a thickness greater than the intermediate cover portion. The thickness of the central portion may vary radially from the center in accordance with the exponential function, $t_r = T \cdot e^{-cB}$, where $t_r$ is the thickness at a given radial point r from the center, $c = (r/R)^2$, where R is the radius of the cover, B is a dispersion constant, and T is a constant that determines the thickness of the central portion at the center.

18 Claims, 8 Drawing Sheets

PARABOLIC COVER FOR MANHOLE

BACKGROUND OF THE INVENTION

1. Technical Field

The present invention relates generally to apparatus used in man-made underground installations, and more particularly to apparatus, such as manhole covers and drain grates, which cover surface openings to such underground installations.

2. Background Art

Manhole covers are among the oldest of commercial products. They are not exempt, however, from the changes being wrought by our modern culture. Most notably, (1) the quality revolution, (2) sociological pressures to make products more ergonomically acceptable to women and the handicapped, and (3) safety concerns for workers entering confined spaces such as manholes.

The quality revolution is leading firms to produce products better suited to the end user at the lowest possible cost. In the case of manhole covers, the goal is to make them easy to remove and handle (low weight), and to use the least amount of material consistent with strength requirements (low weight). In general, consulting engineers and municipal engineers specify the manhole cover designs used in their areas of responsibility. They desire peace of mind that no manhole cover will ever fail in service. Until now, they have relied on historical evidence and proof load tests to assure design strength. Neither method provides rigorous evidence of design adequacy, and neither allows for good value engineering which is necessary to succeed in the quality revolution.

Women are now undertaking careers that have been traditionally held by men. Jobs in construction and maintenance of underground installations, such as sewers and drains, are no exception. Such jobs require the handling of relatively heavy manhole covers which expose any worker, male or female, to the possibility of personal injury. But, with the increase of women in these types of jobs, there has arisen a greater need to reduce the weight of manhole covers.

In some applications, it is desirable to construct a manhole with an opening as large as possible. A large manhole facilitates entry into, and exit out of the installation, especially when the worker is carrying equipment and tools, utilizing breathing apparatus, evacuating disabled workers, or is large in stature. In addition, large manhole openings facilitate the cleaning of underground installations, such as grease traps. However, larger diameter manholes obviously require larger and heavier manhole covers. Thus, there is a need for a manhole cover design which is optimized to reduce the weight of the cover for a given strength requirement (i.e., maximize the strength-to-weight ratio). With such an optimized design, larger manhole covers could be utilized without exposing the worker to an undue risk of injury.

There are two basic types of manhole covers in use today—(1) ribbed covers, and (2) platen covers. Ribbed covers are older, and more traditional in design. They utilize stiffener ribs in concentric circles, radial patterns, or square patterns. There is very little deflection in these covers. The problem with these covers is that less material is located in areas subjected to tension. Grey iron, the most commonly used material for manhole covers, is about three times stronger in compression than in tension. Thus, a ribbed design is the worst choice if grey iron is selected as the material for the cover.

In addition, the stiffeners in ribbed covers are not efficient in a strength-to-weight sense. Ribbed covers do not lend themselves to rigorous value engineering design. The stiffeners in ribbed covers also limit energy absorption. The ability of a manhole cover to absorb energy is determined by the amount of material subjected to bending. As indicated above, there is very little bending in a ribbed cover. Thus, a ribbed cover is more prone to failure, especially when subjected to overload conditions.

Platen covers were introduced in the last two decades. A platen cover has a uniform thickness, except for the annular bearing ring around the periphery of the cover. Platen covers are of a monolithic construction. They provide strength-to-weight characteristics which are improved over ribbed designs, because they have more material in areas of tensile stress. The monolithic design also reduces stress concentrations that contribute to fatigue failure. However, rigorous value engineering is very limited with platen covers, because the designer can only adjust the uniform thickness.

OBJECTS AND SUMMARY OF THE INVENTION

It is therefore an object of the present invention to provide apparatus and methods that avoid the aforementioned problems associated with the prior art.

It is another object of the present invention to minimize the weight of a manhole cover or other framework, for a given strength specification, resulting in a product that is lighter in weight, lower in cost, and/or larger in dimension for a given weight.

It is a further object of the present invention to design a manhole cover or other framework having a rigorously determined margin of safety.

It is still another object of the present invention to provide a manhole cover or other framework that has a smooth, definable monolithic construction.

It is still a further object of the present invention to provide a manhole cover or other framework which is less susceptible to fatigue failure than previous designs.

It is yet another object of the present invention to provide a design methodology for a manhole cover or other framework that is easily manipulated to minimize design stress.

It is yet a further object of the present invention to provide a manhole cover, or other framework, that absorbs more energy from loads and survives overload conditions better than previously known designs.

It is yet still another object of the present invention to provide a nearly uniform stress distribution in a manhole cover or other framework.

It is yet still a further object of the present invention to provide a design for a manhole cover or other framework, which is optimized for the properties of grey iron.

These and other objects are attained in accordance with the present invention, wherein there is provided a framework, such as a manhole cover, for covering an opening to an underground installation. The framework comprises a central cover portion, and an outer bearing portion that surrounds the central cover portion. The central cover portion has a defined point of origin. The thickness or depth of the central portion varies from the point of origin, along a selected axis in accordance with a particular function, such as an exponential or parabolic function. The outer bearing portion of the framework has a thickness or depth that is substantially uniform.

In one particular embodiment, the central cover portion has a thickness (or depth) that varies from the point of origin, along the selected axis, in accordance with the exponential function $t_r=T\cdot e^{-cB}$, where: $t_r$ is the thickness (or depth) at a given point r along the selected axis; $c=(r/R)^2$, where R is the length between the point of origin and the outer most point of the framework on the selected axis; B is a dispersion constant; and T is a constant that determines the thickness (or depth) of the central cover portion at the point of origin.

In another embodiment, the central cover portion has a thickness (or depth) that varies from the point of origin, along the selected axis, in accordance with the parabolic function $t_r=-r^2/4B+T$, where: $t_r$ is the thickness (or depth) at a given point r along the selected axis; B is a dispersion constant; and T is a constant that determines the thickness (or depth) of the central cover portion at the point of origin.

In a further embodiment, an intermediate cover portion may be concentrically disposed between the central cover portion and the outer bearing portion of the manhole cover. The intermediate portion has a substantially uniform thickness. This thickness is less than the thickness of the outer bearing portion or ring. The central cover portion has a thickness that varies radially from its center in accordance with either an exponential or parabolic function. The manhole cover preferably has a smooth monolithic construction.

BRIEF DESCRIPTION OF THE DRAWING

Further objects of the present invention will become apparent from the following description of the preferred embodiments with reference to the accompanying drawing, in which.

DETAILED DESCRIPTION OF THE PREFERRED EMBODIMENTS

Figure 1:
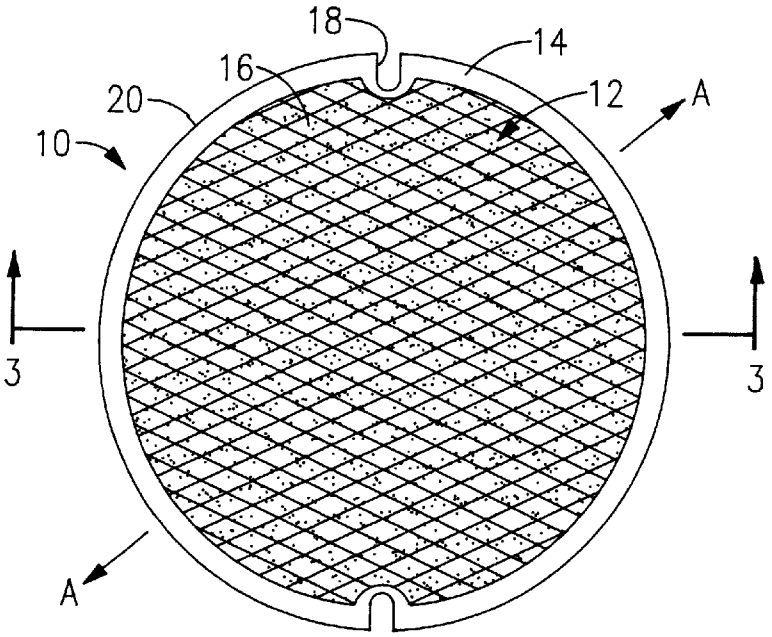
FIG. 1 is a top plan view of a manhole cover constructed in accordance with the present invention.

With reference to FIG. 1, there is shown a top plan view of a circular manhole cover 10, constructed in accordance with the present invention. Cover 10 comprises a circular cover portion 12 surrounded by an annular outer bearing portion or ring 14. Cover portion 12 has a non-slip, substantially planar top surface 16 containing a network of surface slots or grooves 17 (See also FIG. 4). Cover 10 also contains a pair of penetrating pickholes 18 arranged diametrically apposed to one another at a periphery 20 of cover 10.

Figure 2:
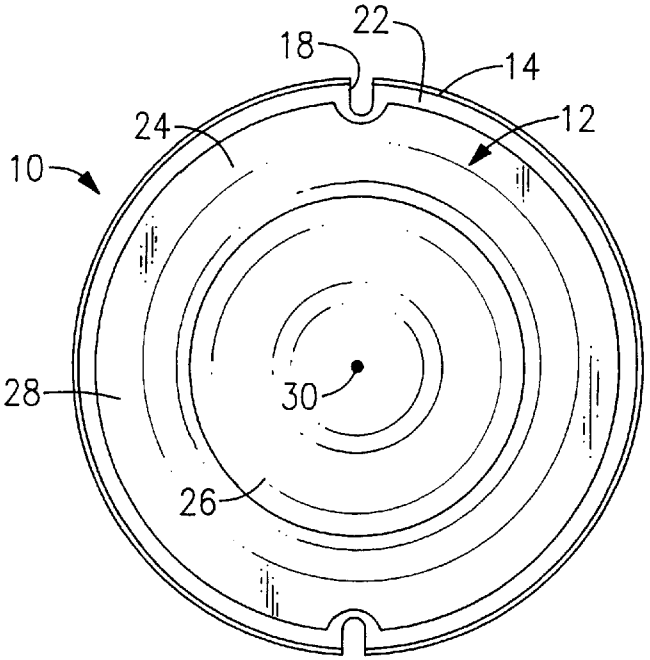
FIG. 2 is a bottom plan view of the manhole cover of FIG. 1.

As shown in the bottom plan view of FIG. 2, bearing ring 14 has a machined bearing surface 22. Bearing surface 22 makes contact with a manhole seat or retaining ring when cover 10 is put in place over a manhole (See FIG. 8). Cover portion 12 has a substantially smooth bottom surface 24. Cover portion 12 is defined by a central cover portion 26 and an intermediate cover portion 28. Central cover portion 26 includes a center point 30, and has a thickness or depth dimension that decreases radially from point 30 in accordance with an exponential function. (See description below with reference to FIG. 5). Alternatively, the thickness or depth dimension of central cover portion 26 may decrease radially from point 30 in accordance with a parabolic function. (See description below with reference to FIG. 6).

Figure 4:
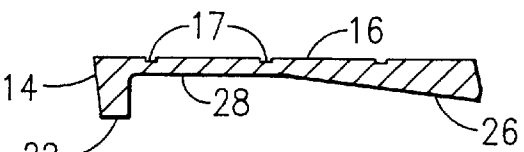
FIG. 4 is an enlarged fragmented view of the circled area 4 shown in FIG. 3.
Figure 3:
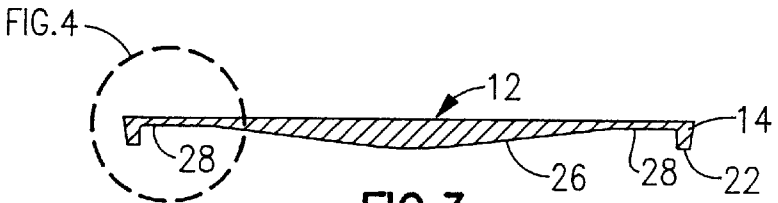
FIG. 3 is a sectional view of the manhole cover of FIG. 1, taken along line 3—3 in FIG. 1.

Intermediate cover portion 28 surrounds central cover portion 26 (See FIG. 2), and has a substantially uniform thickness (See FIGS. 3 and 4). As shown in FIG. 2, outer bearing ring 14 surrounds intermediate cover portion 28. As shown in FIGS. 3 and 4, outer bearing ring 14 has a thickness greater than intermediate cover portion 28.

Manhole cover 10 is entirely monolithic in construction, and may be made of either ductile or non-ductile material.

Although the present invention is described herein with reference to a manhole cover embodiment, it is to be understood that the present invention is not so limited. Any other framework for covering an opening to an underground installation is within the scope of the present invention. For example, a drain grate may be configured in accordance with the present invention and, for the purpose of this disclosure, is considered a framework for covering an opening to an underground installation. In addition, the present invention is not limited to a circular configuration. For example, square and rectangular configurations are also contemplated.

Figure 5:
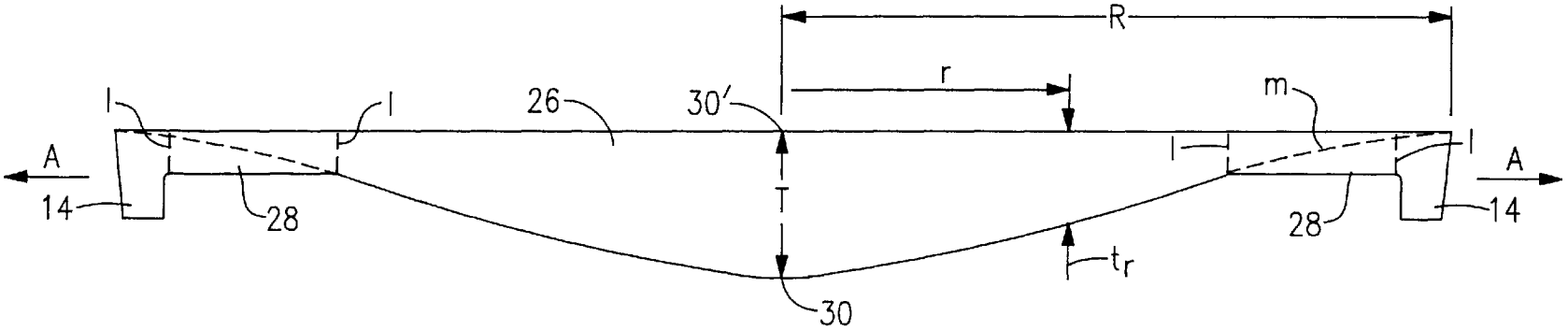
FIG. 5 is a diagrammatic view in cross section of a manhole cover of the present invention, having a thickness that varies in accordance with an exponential function.

Referring now to FIG. 5, there is shown a diagrammatic cross sectional view of manhole cover 10, taken along an axis A—A which intersects the center of cover 10 (See FIG. 1). The purpose of FIG. 5 is to illustrate the method of designing manhole cover 10. Imaginary lines "1" have been drawn to clearly define portions 14, 26 and 28 of manhole cover 10. In actuality, manhole cover 10 is monolithic in construction—the defined portions are not separate parts.

As illustrated in FIG. 5, the thickness or depth dimension $t_r$ of central portion 26 varies radially and symmetrically from point 30 in accordance with the exponential function $$t_r=T\cdot e^{-cB}.$$

The parameters in this function are defined as follows: $t_r$ is the thickness (or depth) at a given point r along axis A—A, where r=0 at a point of origin 30'; $c=(r/R)^2$, where R is the length between point 30' and the outer most point of manhole cover 10 on axis A—A (i.e, the radius of manhole cover 10); B is a dispersion constant; and T is a constant that determines the thickness (or depth) of central cover portion 26 at point 30' (i.e., the maximum thickness of manhole cover 10).

In the preferred method of design, the exponential function is defined over the entire radius of manhole cover 10. That portion of the function which theoretically extends beyond center portion 26, is represented by an imaginary line "m" in FIG. 5. The thickness profile of cover 10 does not follow the exponential function beyond center portion 26. In the preferred embodiment, intermediate cover portion 28 establishes the minimum thickness of cover 10.

Ideally, thickness $t_r$ should follow the exponential function beyond center portion 26; however, this is infeasible for two reasons. First, the materials used to make manhole covers are relatively brittle, requiring some minimum thickness. The more brittle the material is, the greater the required minimum thickness. For example, grey iron requires a minimum thickness of about 3/8ths of an inch. Second, typical manufacturing processes for manhole covers require a minimum thickness—approximately 3/8ths of an inch. Therefore, the inclusion of an intermediate portion becomes necessary, in this embodiment, to establish the required minimum thickness.

Figure 6:
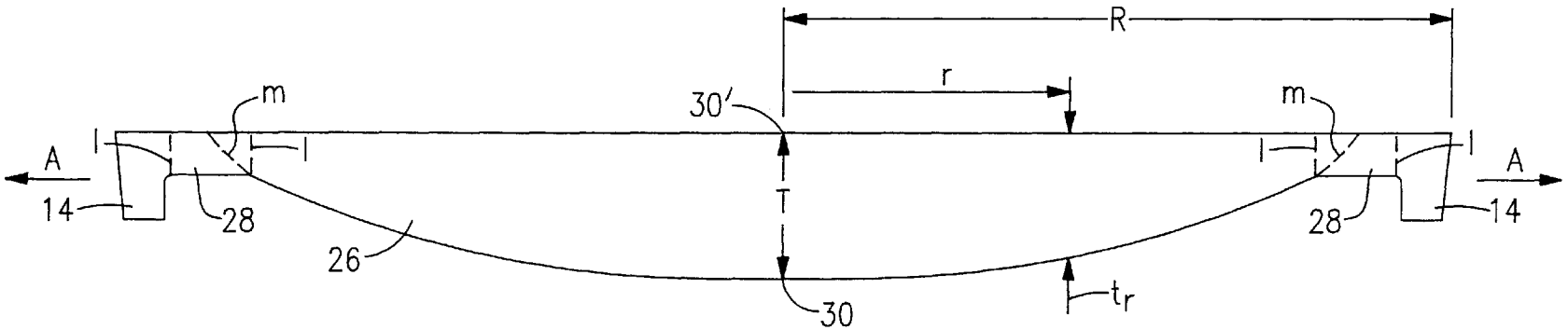
FIG. 6 is a diagrammatic view in cross section of a manhole cover of the present invention, having a thickness that varies in accordance with a parabolic function.

In an alternative embodiment, illustrated in FIG. 6, the thickness or depth, $t_r$, of central portion 26 varies (e.g., decreases) radially and symmetrically from point 30 in accordance with the parabolic function $$t_r=-r^2/4B+T.$$

The parameters in this function are defined as follows: $t_r$ is the thickness (or depth) at a given point r along axis A—A, where r=0 at point of origin 30'; B is a dispersion constant; and T is a constant that determines the thickness (or depth) of central portion 26 at point 30' (i.e., the maximum thickness of manhole cover 10).

In the preferred method of design, the parabolic function is defined over the entire radius of manhole cover 10. That portion of the function which theoretically extends beyond center portion 26, is indicated by imaginary line "m" in FIG. 6. The thickness profile of cover 10 does not follow the parabolic function beyond center portion 26. As with the exponential embodiment, an intermediate cover portion 28 (See FIG. 6) is included to establish a minimum thickness for cover 10. For the same reasons described above with respect to the exponential embodiment, the thickness $t_r$ should not fall below this minimum thickness.

Figure 7:
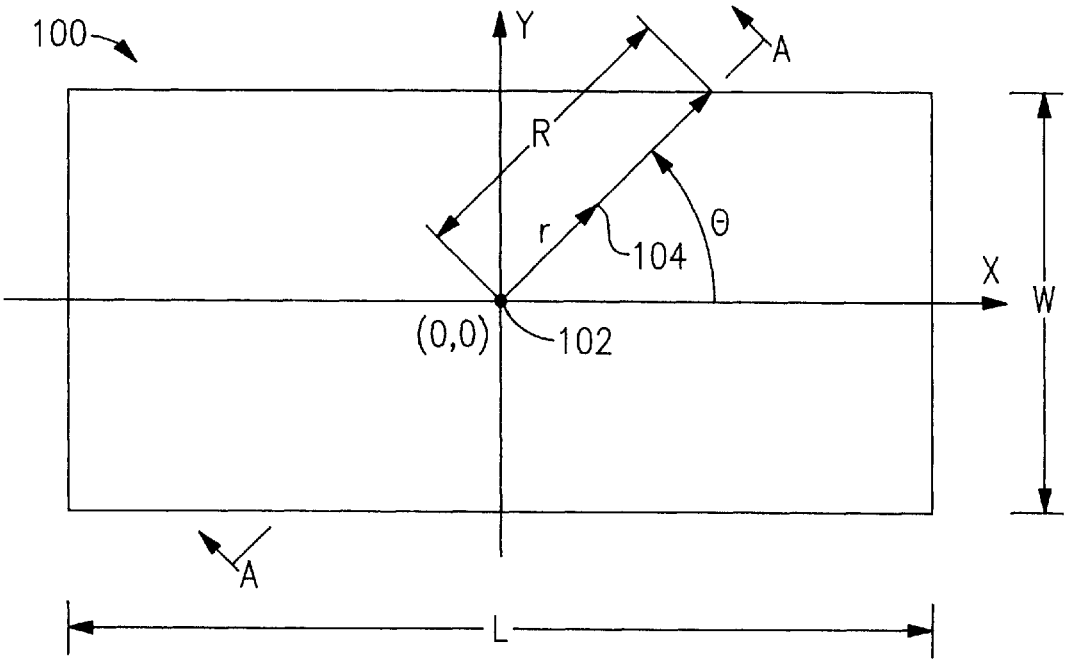
FIG. 7 is a diagrammatic top plan view of a rectangular manhole cover or drain grate of the present invention, illustrating a method of calculating the variable thickness or depth of said manhole cover or drain grate.

As previously mentioned, a manhole cover or drain grate configured in accordance with the present invention, can have a square or rectangular shape. FIG. 7 illustrates a rectangular framework 100 (which could be manhole cover or drain grate) having a length "L" and a width "W". Framework 100 has a defined point of origin 102. Point 102 is coordinate 0,0 in the x,y coordinate system shown in FIG. 7. As with its circular counterparts, rectangular framework 100 has a central cover portion, the thickness or depth of which varies in accordance with an exponential or parabolic function.

The exponential and parabolic functions for rectangular framework 100 are the same as for the circular configurations, except that $t_r$ represents the thickness or depth at a particular point 104 in the x,y coordinate system, along a particular axis A—A (See FIG. 7). As understood from FIG. 7, R varies as a function of θ, and for the positive x,y quadrant of framework 100 the relationship is as follows:

For θ=0° to Arctan (W/L)

$$R=L/2 \cos \theta$$

For θ=Arctan (W/L) to 90°

$$R=W/2 \sin \theta.$$

R is the length between point 102 and the outer most point of framework 100 on axis A—A. The constant T determines the thickness (or depth) of framework 100 at point 102. As with its circular counterparts, framework 100 also includes an outer bearing portion having a substantially uniform depth.

In use, a manhole cover or drain grate is uniformly supported on its outer bearing ring. The typical load condition for a manhole cover or drain grate is a load placed at the center of the cover or grate while being supported on its outer bearing ring. The parabolic and exponential functions, embodied in the central cover portion of the cover or grate, are intended to compensate for the stresses created in the cover or grate by the above-mentioned load condition. Work with Finite Element Analysis supports such a compensation effect. Such analysis has shown that the stress distribution is nearly leveled in the cover or grate (See, e.g., FIG. 9). The exception is the low stress area near the outside of the cover or grate. This condition occurs because the thickness of the cover or grate cannot follow the parabolic or exponential function below a required minimum thickness for a practical embodiment.

Manhole cover and drain grate designs are analyzed and tested in accordance with proof load specifications from the AASHTO Standard Specification for Drainage Structure Castings. The common most proof load test under these specifications is one that simulates a tractor trailer parked, with one tire resting on the center of the cover or grate under test. The "footprint" of the tire, on the cover or grate, is nine (9) inches by nine (9) inches (i.e., a nine inch square). The simulated load is 40,000 pounds, uniformly distributed over the 9×9 inch area. The manhole cover or drain grate is simply supported at its bearing ring or edges.

Figure 8:
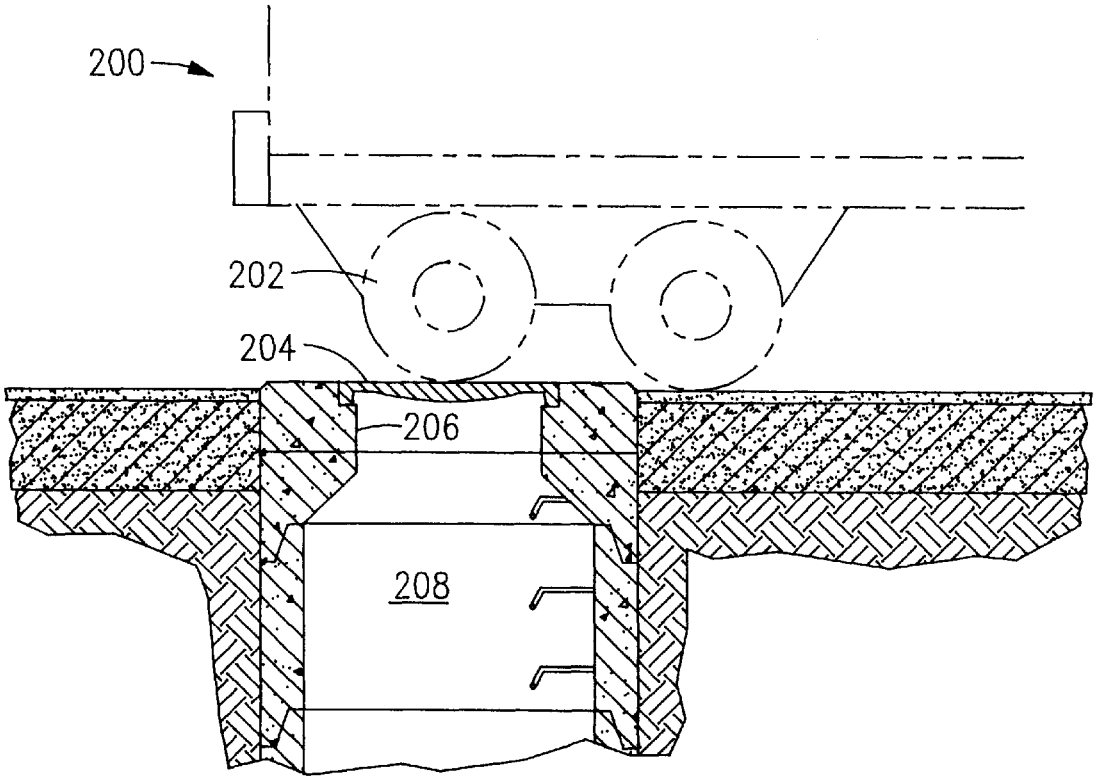
FIG. 8 is a diagrammatic view of a manhole cover of the present invention, covering a manhole and being under load.

FIG. 8 is a diagram of what this test specification seeks to simulate. As shown in FIG. 8, a tractor trailer 200 is parked with a rear tire 202 centered over a manhole cover 204. Cover 204 is supported at is bearing ring in a manhole cover seat or support 206. Cover 204 covers a manhole 208 which leads to an underground installation, such as a sewer drain.

Figure 9:
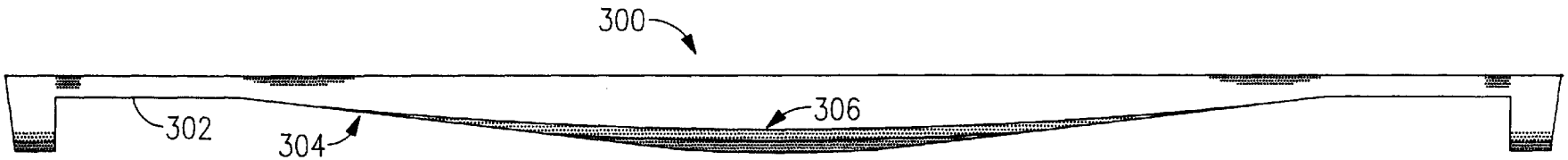
FIG. 9 is a diagrammatic view in cross section of a circular manhole cover of the present invention, illustrating the stress distribution of the cover under load.
Figure 10:
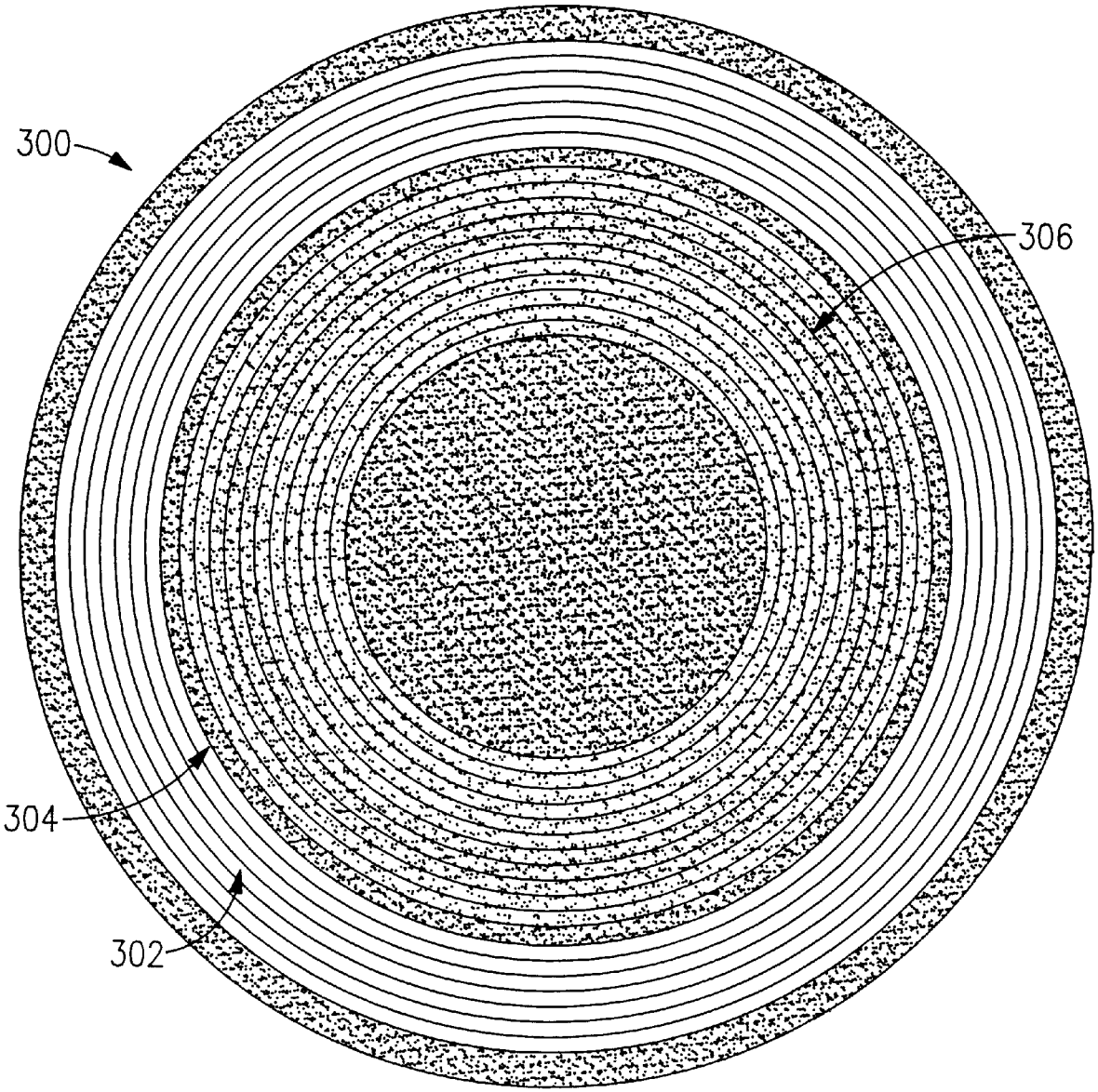
FIG. 10 is a diagrammatic bottom plan view of the manhole cover of FIG. 9, illustrating the stress distribution of the cover under load.

FIGS. 9–15 are a series of diagrams showing the calculated stress distribution in three different manhole cover designs. The AASHTO proof load specification described above was used. The stress distribution was calculated using Finite Element Analysis. FIGS. 9 and 10 show cross-sectional and bottom plan views, respectfully, of a circular manhole cover 300. Cover 300 has an intermediate cover portion 302 of uniform thickness, and a central cover portion 304 with a thickness profile following the exponential function $t_{r=T\cdot e^{-cB}}$. The diameter of cover 300 is 32 inches, the thickness of intermediate portion 302 is 0.5 inches, and the maximum thickness T of central portion 304 is 1.5 inches. As shown in FIGS. 9 and 10, a region 306 of high stress (stippled area) is nearly uniformly distributed over central cover portion 304.

Figure 11:
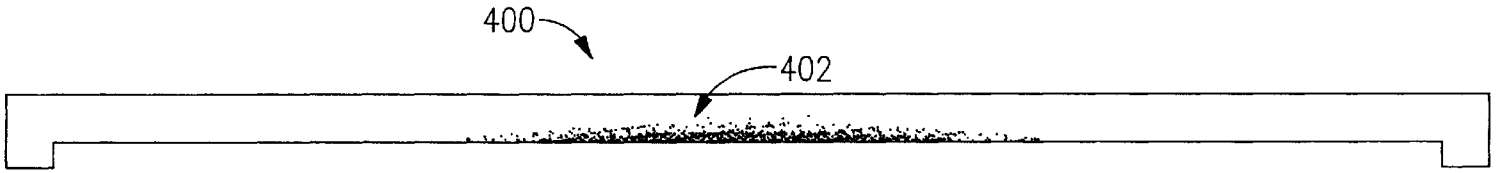
FIG.11 Prior Art
FIG. 11 is a diagrammatic view in cross section of a circular platen manhole cover of the prior art, illustrating the stress distribution of the cover under load.
Figure 12:
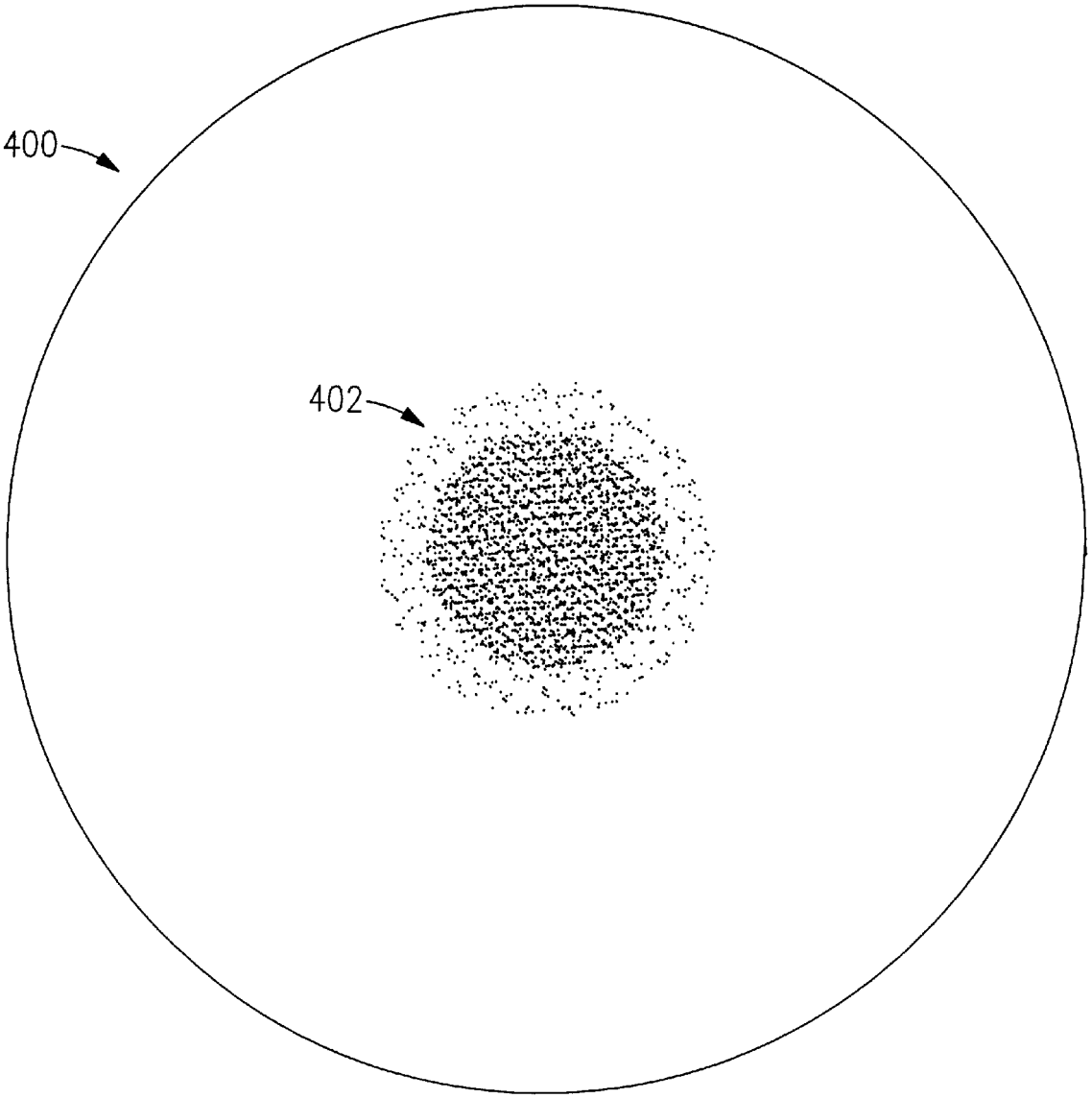
FIG. 12 Prior Art
FIG. 12 is a diagrammatic bottom plan view of the manhole cover of FIG. 11, illustrating the stress distribution of the cover under load.

FIGS. 11 and 12 show cross-sectional and bottom plan views, respectfully, of a circular platen manhole cover 400. Cover 400 has a diameter of 32 inches and a uniform thickness of one (1) inch. As shown in FIGS. 11 and 12, a region 402 of high stress is concentrated at the center of cover 400.

Figure 13:
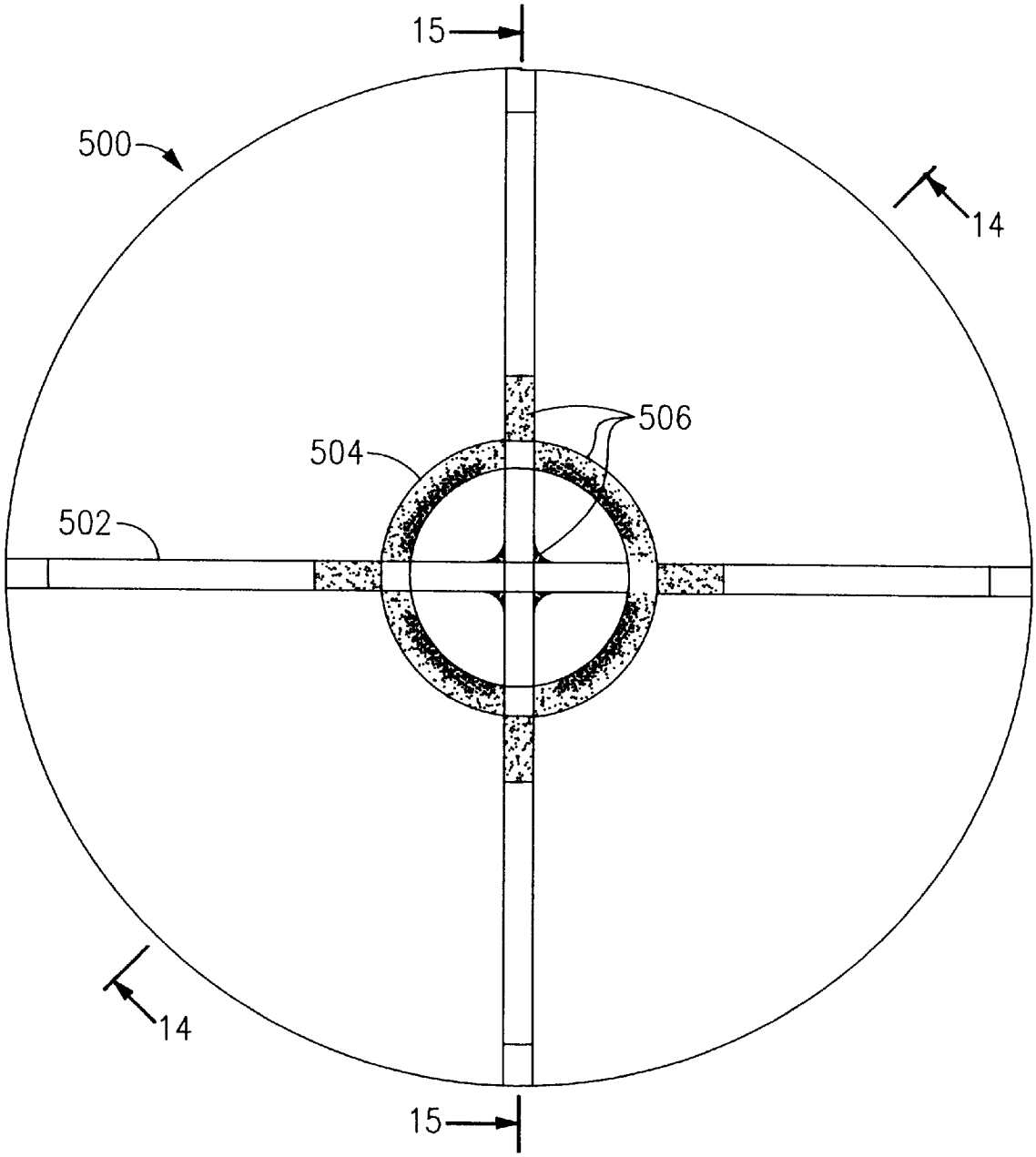
FIG.13 Prior Art
FIG. 13 is a diagrammatic bottom plan view of a circular ribbed manhole cover of the prior art, illustrating the stress distribution of the cover under load.
Figure 14:
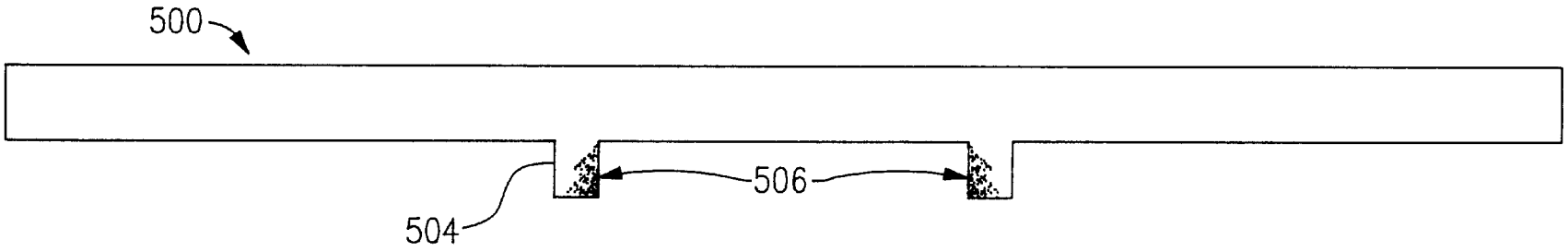
FIG.14 Prior Art
FIG. 14 is a diagrammatic view in section of the manhole cover of FIG. 13, taken along line 14—14 in FIG. 13, illustrating the stress distribution of the cover under load.
Figure 15:
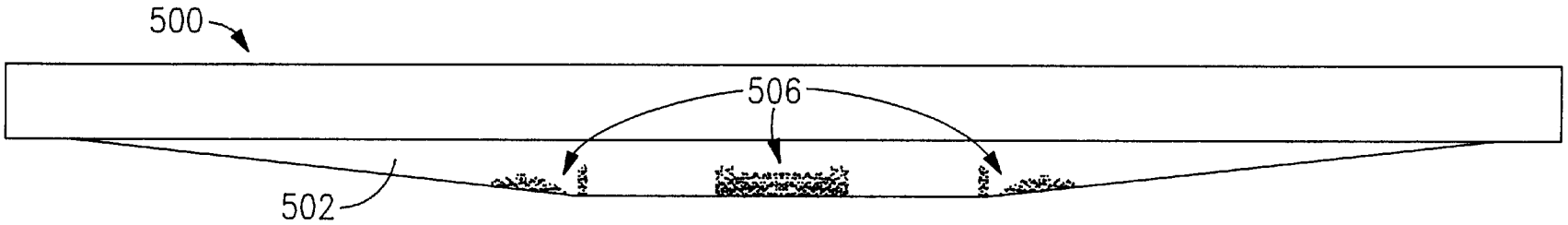
FIG.15 Prior Art
FIG. 15 is a diagrammatic view in section of the manhole cover of FIG. 13, taken along line 15—15 in FIG. 13, illustrating the stress distribution of the cover under load.

FIG. 13 shows a bottom plan view and FIGS. 14 and 15 show sectional views of a circular ribbed manhole cover 500. Cover 500 has radially projecting ribs 502 and a circular rib 504. The diameter of cover 500 is 32 inches. As shown in FIGS. 13–15, regions 506 of high stress are concentrated in ribs 502 and 504, at and near the center of cover 500.

A comparison of the stress analysis results of manhole cover 300 (FIGS. 9–10) with the results of covers 400 and 500 (FIGS. 11–15), makes clear that the design of the present invention is significantly better in distributing stresses in the manhole cover due to typical load conditions. Such superior performance allows a designer to reduce the weight of the cover, over previous designs, for a given load requirement.

The present invention is applicable to any material, ductile or non-ductile, used to make manhole covers and drain grates. Ductile iron and steel are examples of such ductile materials. Grey iron is the most common non-ductile material used to make manholes covers. It should be noted that the present invention is uniquely suited for the properties of grey iron.

In the design process of a manhole cover or drain grate of the present invention, the constants T (maximum thickness) and B (dispersion factor), in the previously described parabolic and exponential functions, are manipulated to minimize weight (or volume) at an allowable stress level. This is done with iterative Finite Element Analysis solutions. Such an analytic approach allows for rigorous value engineering of the product.

In summary, the process of configuring a manhole cover or drain grate (i.e., framework) of the present invention, comprises the steps of: (a) specifying the material to be used (e.g., grey iron, ductile iron, etc.), the maximum allowable stress and the minimum section thickness appropriate for that material; (b) specifying the outside radius of the framework for a circular configuration, or the length and width of the framework for a rectangular or square configuration; (c) specifying the thickness of the annular bearing ring; (d) selecting a particular function for calculating the variable thickness of the framework (e.g., exponential, parabolic, etc.); (e) selecting values for the thickness constant "T" and the dispersion constant "B"; (f) calculating the variable thickness of the framework using the function selected in step (d) and the values selected in step (e); (g) defining an intermediate cover portion for the framework using the minimum section thickness specified in step (a); (h) composing a complete design of the framework using the calculated results obtained in step (f) and the specifications of steps (a)–(c), (e) and (g); (i) calculating the maximum stress level for the framework design based on a particular load condition, and comparing it with the maximum allowable stress specified in (a); (j) adjusting, if necessary, the thickness constant "T" and/or dispersion constant "B" and repeating steps (f) through (i) until the weight of the framework is minimized at the maximum allowable stress specified in step (a); and (k) producing a framework in accordance with the design composed in steps (h) and adjusted in step (j). Step (i) is preferably performed with iterative Finite element Analysis solutions. Step (k) is preferably performed using standard foundry casting processes.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What is claimed is:

1. A manhole cover of substantially monolithic construction, comprising:

a central cover portion having a center, and having a thickness that varies radially from the center in accordance with an exponential function;

an intermediate cover portion, surrounding said central cover portion and having a substantially uniform thickness; and an outer bearing portion, surrounding said intermediate cover portion and having a thickness greater than said intermediate cover portion.

2. The manhole cover as recited in claim 1, wherein the thickness of said central cover portion varies radially from the center in accordance with the function $$t_r = T \cdot e^{-cB}$$

where $t_r$ is the thickness at a given radial point r from the center, $c=(r/R)^2$ where R is the radius of the cover, B is a dispersion constant, and T is a constant that determines the thickness of said central cover portion at the center.

3. The manhole cover as recited in claim 2, wherein the shape of said manhole cover is substantially circular.

4. The manhole cover as recited in claim 3, wherein said manhole cover is made of a non-ductile material.

5. The manhole cover as recited in claim 4, wherein said manhole cover contains at least one pickhole.

6. The manhole cover as recited in claim 4, wherein the non-ductile material is grey iron.

7. A framework for covering an opening to an installation, comprising:

a central cover portion having a point of origin and a depth that varies from the point of origin along an axis in accordance with an exponential function;

an intermediate cover portion, surrounding said central cover potion and having a substantially uniform thickness along said axis; and an outer bearing portion, surrounding said intermediate cover portion and having a depth that is substantially uniform, said outer bearing portion having a thickness greater than said intermediate cover portion.

8. The framework as recited in claim 7, wherein said central cover portion has a depth that varies from the point of origin, along the axis, in accordance with the function $$t_r _ T \cdot e^{-cB}$$

where $t_r$ is the depth at a given point r along the axis, $c=(r/R)^2$ where R is the length between the point of origin and the outer most point of the framework on the axis, B is a dispersion constant, and T is a constant that determines the depth of said central cover portion at the point of origin.

9. The framework as recited in claim 8, wherein said framework is a manhole cover.

10. The framework as recited in claim 9, wherein said manhole cover has a substantially planar top surface.

11. The framework as recited in claim 10, wherein said manhole cover is of a substantially monolithic construction.

12. The framework as recited in claim 11, wherein said manhole cover is substantially circular in shape.

13. The framework as recited in claim 12, wherein said manhole cover is made of grey iron.

14. A manhole cover of substantially monolithic construction, comprising:

a central cover portion having a center, and having a thickness that varies radially from the center in accordance with a parabolic function;

an intermediate cover portion, surrounding said central cover portion and having a substantially uniform thickness; and an outer bearing portion, surrounding said intermediate cover portion and having a thickness greater than said intermediate cover portion.

15. The manhole cover as recited in claim 14, wherein said central cover portion has a thickness that varies radially from the center in accordance with the function $$t_r=-r^2/4B+T$$

where $t_r$ is the thickness at a given radial point r from the center, r=0 at the center, B is a dispersion constant, and T is a constant that determines the thickness of said central cover portion at the center.

16. A framework for covering an opening to an installation, comprising:

a central cover portion; and an outer bearing portion surrounding said central cover portion, said central cover portion having a defined point of origin, and having a depth that varies from the point of origin along an axis in accordance with a parabolic function, and said outer bearing portion having a depth that is substantially uniform.

17. The framework as recited in claim 16, wherein said central cover portion has a depth that varies from the point of origin, along the axis, in accordance with the function $t_r=-r^2/4B+T$, where $t_r$ is the depth at a given point r along the axis, r=0 at the point of origin; B is a dispersion constant; and T is a constant that determines the depth of said central portion at the point of origin.

18. A method of configuring a framework for covering an opening to an installation, comprising the steps of:

(a) specifying the outside radius of the framework for a circular configuration, or the length and width of the framework for a rectangular or square configuration;

(b) specifying a maximum thickness parameter for the framework;

(c) specifying a maximum allowable stress for the framework;

(d) selecting a particular function for calculating a variable thickness of the framework;

(e) calculating the variable thickness of the framework using said function and at least the parameters specified in steps (a) and (b);

(f) composing a complete design of the framework using the results obtained in step (e),; the complete design including a central cover portion having a variable thickness, an intermediate cover portion surrounding said central cover portion and having a substantially uniform thickness, and an outer bearing portion surrounding said intermediate cover portion and having a thickness greater than said intermediate cover portion.

(g) calculating the maximum stress level for the framework design based on a particular load condition, and comparing the calculated level with the maximum allowable stress specified in step (c);

(h) adjusting, if necessary, at least one of the parameters used in the calculation of step (e) and repeating steps (e), (f) and (g), until the weight of the framework is minimized for a particular stress; and (i) producing a framework in accordance with the design composed in step (f) and adjusted, if necessary, in step (h).

* * * * *